US007449656B2

(12) United States Patent
Madar et al.

(10) Patent No.: US 7,449,656 B2
(45) Date of Patent: Nov. 11, 2008

(54) POSTAL-ITEM PROCESSING METHOD, INCLUDING RANK MONITORING

(75) Inventors: François Madar, Bourg les Valence (FR); Bruno Cartal, Montelier (FR); David Morisot, Guilherand-Granges (FR)

(73) Assignee: Solystic, Gentilly Cedex (FR)

( * ) Notice: Subject to any disclaimer, the term of this patent is extended or adjusted under 35 U.S.C. 154(b) by 246 days.

(21) Appl. No.: 11/386,817

(22) Filed: Mar. 23, 2006

(65) Prior Publication Data

US 2006/0213818 A1 Sep. 28, 2006

(30) Foreign Application Priority Data

Mar. 24, 2005 (FR) ..... 05 50770

(51) Int. Cl.
*B07C 5/00* (2006.01)

(52) U.S. Cl. ..... 209/584; 209/583; 209/900; 700/223; 700/224; 700/225; 700/226; 700/227

(58) Field of Classification Search ..... 209/583, 209/584, 900

See application file for complete search history.

(56) References Cited

U.S. PATENT DOCUMENTS

| | | | | |
|---|---|---|---|---|
| 6,316,741 | B1 * | 11/2001 | Fitzgibbons et al. | 209/584 |
| 2006/0037888 | A1 * | 2/2006 | Wheeler et al. | 209/12.1 |
| 2006/0124513 | A1 * | 6/2006 | McLaughlin et al. | 209/584 |
| 2007/0090028 | A1 * | 4/2007 | Varney | 209/584 |

* cited by examiner

*Primary Examiner*—Patrick Mackey
*Assistant Examiner*—Kalyanavenkateshware Kum
(74) *Attorney, Agent, or Firm*—Sughrue Mion, PLLC

(57) ABSTRACT

A method of processing postal items in a postal sorting machine for preparing delivery rounds in a plurality of sorting passes (typically two sorting passes) includes a step that is performed during a sorting pass and for each current item, said step consisting in monitoring (31, 33, 35, 37, 38, 39) data representative of an order number or rank allocated to the distribution point corresponding to the current postal item in a predetermined sequence of distribution points to be run through this sorting pass in order to prepare each delivery round, the monitoring consisting in observing how rank varies for successive postal items in order to detect any difference relative to said predetermined sequence. In response to detecting such a difference for a current item, said current item is put back into circulation through the machine in order to delay its sorting and thus recreate the expected sequence.

5 Claims, 3 Drawing Sheets

14

| | Distribution point | Rank | Logical destination | Identifier | Recycled |
|---|---|---|---|---|---|
| B | --- | --- | --- | --- | --- |
| C | --- | --- | --- | --- | --- |
| D | --- | --- | --- | --- | --- |
| E | --- | --- | --- | --- | --- |
| F | --- | --- | --- | --- | --- |
| G | --- | --- | --- | --- | --- |
| H | --- | --- | --- | --- | --- |
| I | --- | --- | --- | --- | --- |
| J | --- | --- | --- | --- | --- |
| K | --- | --- | --- | --- | --- |
| | 15 | 16 | 17 | 18 | 19 |

50

| | Sanction | Current rank | Ranks of items in observation window | | | | | | | | | |
|---|---|---|---|---|---|---|---|---|---|---|---|---|
| L1 | OK | N | **N** | N | N-1 | N-1 | N-1 | N-1 | N | N | N | N |
| L2 | OK | N | **N** | N-1 | N-1 | N-1 | N-1 | N | N | N | N | N |
| L3 | Reject | N | **N-1** | N-1 | N-1 | N-1 | N | N | N | N | N | N |
| L4 | Recycle / OK | N | **N-1** | N-1 | N-1 | N | N | N | N | N | N | N-1 |
| L5 | Recycle / OK | N | **N-1** | N-1 | N | N | N | N | N | N | N-1 | N-1 |
| L6 | Recycle / OK | N | **N-1** | N | N | N | N | N | N | N-1 | N-1 | N-1 |
| L7 | OK | N | **N** | N | N | N | N | N | N-1 | N-1 | N-1 | N-1 |
| L8 | OK | N | **N** | N | N | N | N | N-1 | N-1 | N-1 | N-1 | N-1 |
| L9 | OK | N | **N** | N | N | N | N-1 | N-1 | N-1 | N-1 | N-1 | N-1 |

51 52 16

POSTAL-ITEM PROCESSING METHOD, INCLUDING RANK MONITORING

PRIOR ART

The present invention relates to a method of processing postal items in a postal sorting machine in order to prepare delivery rounds or "postmen's walks" in a plurality of sorting passes, typically two sorting passes. The invention applies more particularly to a postal sorting machine having a carrousel of trays, in which the postal items travel in the trays above sorting outlets.

Present-day sorting machines are not capable of completely avoiding sorting errors while preparing delivery rounds. A sorting error in a delivery round gives rise to an item being wrongly placed in the delivery round. By way of example, a sorting error may be due to multiple items being taken simultaneously as a bunch during a first pass, but it can also be due to errors in the handling of items between two sorting passes (e.g. an operator inverting articles while they are being loaded onto the feed magazine).

The consequence of one or more sorting errors in a delivery round is a non-negligible extra expense for the postal operator in charge of delivering the mail. That is why known methods of processing postal items in a sorting machine make use of various monitoring means, and in particular means for automatically checking whether multiple items have been taken as a bunch and for directing such items taken as a bunch of multiple items to a reject outlet where they are recovered for manual sorting. For example, U.S. Pat. No. 6,316,741 describes a method of processing postal items in which a monitoring of the sequence in which items pass through is performed in order to detect sorting errors. In the known method, in case of the detection of a sorting error, a manual sort is performed on the detection identified item. Manually inserting items into a stack of sequenced articles in order to remedy sorting errors is expensive in terms of operator time and delay.

The object of the invention is to propose a method of processing postal items that makes it possible to avoid sorting errors in delivery rounds and that also makes it possible to increase the proportion of items that are sorted automatically.

SUMMARY OF THE INVENTION

The idea according to the invention is to perform a rank monitoring in a machine for sorting postal items having a carrousel of trays consisting in checking during a sorting pass, for each current item, data representative of an order number or rank allocated to the distribution point corresponding to the current postal item in a predetermined sequence of distribution points to run through this sorting pass in order to prepare each delivery round; the checking consisting in monitoring how rank varies for successive postal items in order to detect any difference relative to said predetermined sequence; and, based on this rank monitoring, i.e. in response to said detection for a current item, the machine is controlled so as to cause the current item to recirculate through the machine so as to retard the sorting of the current item and thus recreate the expected sequence by making this current item carrying out one complete revolution round the carrousel. To summarize, the invention take advantage of the recirculation possibilities given by a machine having a carrousel of trays in order to correct sorting errors resulting for example of a defective unstacking of the postal items. This consists in deciding to recirculate items checked as out of the rank through monitoring instead of rejecting them. The current item is then expected to be, after a complete revolution round the carrousel, in sequence with the items surrounding it, at the time for a new sorting decision, because its rank might then correspond to the current rank. The rank monitoring has then further for purpose to ensure that after a revolution of the carrousel, the current item is, or is not, in sequence. The rank monitoring further consists in observing the rank of the current postal item in a portion, or "observation window", of said sequence constituted by a certain number of consecutive postal items More particularly, the invention provides a method of processing postal items in order to prepare delivery rounds by performing a plurality of sorting passes through a postal sorting machine having a carrousel of trays in which the postal items travel in trays above the sorting outlets and are deposited in the appropriate sorting outlets, the method comprising the steps consisting in: checking in the machine during a sorting pass, for each current item, data representative of an order number or rank allocated to the distribution point corresponding to the current postal item in a predetermined sequence of distribution points to run through this sorting pass in order to prepare each delivery round; the checking consisting in monitoring how rank varies for successive postal items in order to detect any difference relative to said predetermined sequence; the method being characterized in that in response to said detection of a difference for a current postal item: the rank of the current postal item is observed in a portion, or "observation window", of said sequence constituted by a certain number of consecutive postal items and if the rank of the current postal item is one less than a current rank; a first number of postal items of rank one more than the rank of the current postal item is counted in the observation window and a second number of postal items having the same rank as the current postal item is counted in said window; and if the first number is less than a determined first threshold S1 and the second number is greater than a determined second threshold S2, then the machine is controlled so as to cause the current postal item to be deposited in the appropriate sorting outlet; whereas if the first number is greater than the determined first threshold S1 and/or the second number is less than the determined second threshold S2, then the machine is controlled so as to cause the current postal item to return to the observation window after making one complete revolution round the carrousel.

Consequently, according to the invention, in response to a sorting error being detected for the current item, the current item is caused to recirculate through the machine so as to retard its sorting and thus recreate the expected sequence.

If a two-pass sorting plan is used in which the distribution points of each round are shared successively over N1 sorting outlets of the machine during a first pass with the last distribution point of any one round being followed immediately by the first distribution point of another round, and in which the distribution points allocated to the N1 sorting outlets during the first pass are shared during a second pass over N2 outlets of the machine while following a certain order in the processing of the N1 sorting outlets, in the method of the invention, it is possible by monitoring rank during the second sorting pass to detect that a current postal item is present in the machine in a manner that is not correct according to the sorting plan and will therefore be wrongly placed during the delivery round. For example, the current postal item may be a postal item that was taken as part of a bunch during the first sorting pass but that has been taken separately during the second pass, or else an item that was unstacked in front of the item preceding it. The method of the invention makes it possible to detect sorting errors and to cause postal items to be put back into circulation in the machine so as to restore coherence in the order of the postal items by deferring machine sorting of critical postal items, when that is possible, instead of merely sending them to a reject outlet.

In a particular implementation of the method of the invention, observations are also made in the observation window of the sorting outlets in which a certain number of consecutive postal items ought to be located, and if the first number is greater than the first determined threshold S1 and/or the second number is less than the second determined threshold S2, and if no postal item of rank one more than the rank of the current postal item is to be placed in the sorting outlet in which the current postal item is placed, then the machine is instructed to place the current postal item in the appropriate sorting outlet.

The invention extends also to a method of processing postal items in order to prepare delivery rounds by performing a plurality of sorting passes through a postal sorting machine having a carrousel of trays in which the postal items travel in trays above sorting outlets and are deposited in the appropriate sorting outlets, wherein the method comprises the steps in which if it is detected that a postal item transported in the machine by the carrousel of trays can not be deposit into a sorting outlet, this postal item is caused to recirculate by controlling the machine in order this postal item performs a complete revolution round the carrousel. In this method, it can be appreciated that the recirculation can be controlled by a detection of the type of a rank monitoring but also for example of the type of a verification of the unavailability of a sorting outlet in the machine. Naturally, this method can be implemented in juxtaposition with a step of checking in the machine during a sorting pass, for each current item, data representative of an order number or rank allocated to the distribution point corresponding to the current postal item in a predetermined sequence of distribution points to run through this sorting pass in order to prepare each delivery round; the checking consisting in monitoring how rank varies for successive postal items in order to detect any difference relative to said predetermined sequence. The rank monitoring allows then to ensure that a recirculated postal item can, or not, be sorted and does not create a sequencing error. This monitoring method before choosing the sanction to apply to a recirculated postal item allows the implementation of a recirculation function during a second sorting pass, which was until now impossible because it was not known if the sort of such a recirculated postal item would, or not, disturb the sorting sequence.

The invention extends to a carrousel of trays type sorting machine specially designed to implement the above-defined methods of processing postal items.

Rank monitoring in accordance with the invention can also be used during a second sorting pass to synchronize the merging of different batches of items coming from respective first sorting passes on different sorting machines.

The invention can be better understood on reading the following description and on examining the accompanying figures. This description is given purely by way of indication and is not limiting on the invention in any way.

DETAILED DESCRIPTION OF THE INVENTION

Figure 1:
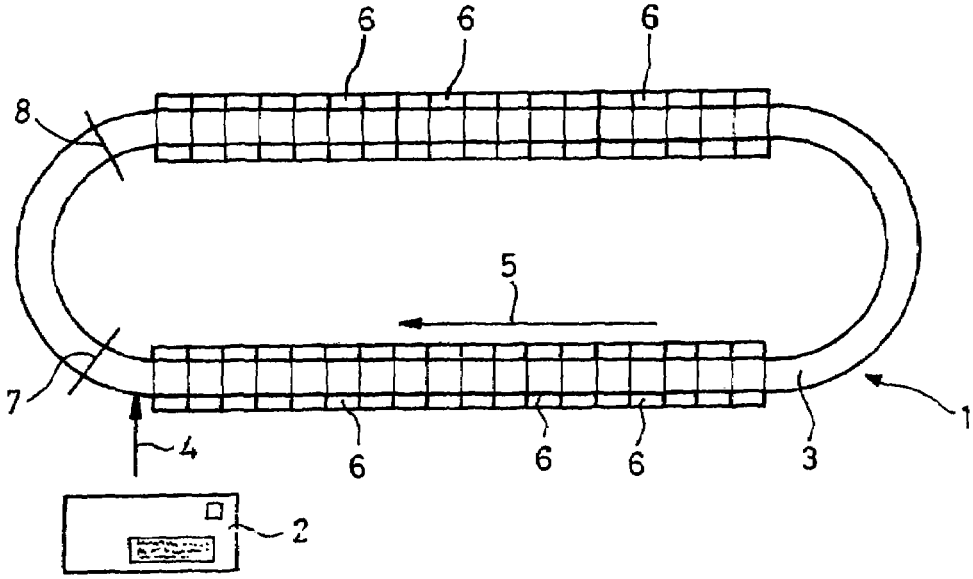
FIG. 1 is a very diagrammatic view of a carrousel postal sorting machine with trays arranged to implement the method of the invention.

In FIG. 1, there can be seen a machine 1 for sorting postal items 2, the machine comprising a carrousel 3, or annular circulating conveyor, of trays. The postal items 2 are serialized by an unstacker (not shown) at the inlet of the machine, and are injected as represented by arrow 4 into the trays of a carrousel circulating in the direction indicated by arrow 5 above a plurality of sorting outlets 6 of the machine.

Each tray normally transports a single postal item 2 to a sorting outlet 6 that is determined on the basis of automatically recognizing the postal address of the item by means of optical character recognition (OCR). Each postal item address corresponds to a distribution point in a delivery round and each distribution point is associated with a sorting outlet during a first or a second pass on the basis of a pre-established sorting plan as mentioned above.

At the end of the first pass, the postal items are returned to the inlet of the machine in a certain order (or sequence), e.g. by means of an automated system for handling tubs known as an automated tub management system (ATMS). With such a handling system, each sorting outlet is provided with a tub into which the postal items are loaded. In particular, at the end of the first pass, the tub is taken from the last sorting outlet of the machine and the postal items in the tub are reinserted into the machine in order to perform the second sorting pass. Then the tub is taken from the last-but-one sorting outlet of the machine and the postal items in that tub are subsequently reinserted into the machine, and so on until the items from the first sorting outlet of the machine have been reinserted. It will be understood that if N1 sorting outlets are used during the first pass shared successively amongst the distribution points of the delivery rounds, the last sorting outlet has the rank "N1" and the first sorting outlet has the rank "1" in the succession of N1 sorting outlets. Under such circumstances, if each distribution point is associated with the rank of the corresponding sorting outlet associated therewith during the first sorting pass and if during the second sorting pass the rank of the distribution point corresponding to each current postal item passing through the machine is read, it is possible to verify that the rank values for the successive postal items during the second sorting pass vary in a manner that is continuous, and in particular that decreases if it is considered that the rank of the last sorting outlet has a value that is greater than the rank of the first sorting outlet. Any sawtooth variation in the ranks, for example, is indicative of an error in the positioning of one or more postal items and thus of a sorting error in a delivery round that is detected by the method of the invention.

Figure 2:
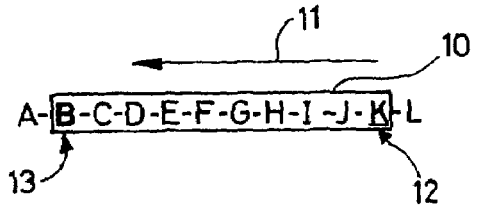
FIG. 2 shows an observation window for monitoring rank in accordance with the invention.

In FIG. 2, there can be seen a series of consecutive postal items referenced A, B, C, . . . , L that have accumulated in the sorting machine 1 during a second pass, and the rectangle 10 represents an observation window covering a certain number of these accumulated postal items between points 7 and 8 of the carrousel 3. In practice, the observation window 10 is a file 14 or table in a memory operating as a first-in-first-out (FIFO) stack in which there are recorded certain characteristics of these consecutive items, and from which rank is monitored in accordance with the invention.

In FIG. 2, the arrow 11 represents the circulating movement of the postal items in the machine between the points 7 and 8, and thus the direction in which the postal items accumulate in the observation window 10. In the example of FIG. 2, item A is no longer in the observation window, item B is the first item entered into the observation window (first in), and item K is the item that entered the observation window last. Below, the last item entered into the observation window 10, i.e. the item that has just passed the insertion point 7, is referred to as the "inserted item" 12 and the first item to enter into the observation window, and thus the item that is about to pass the "sanction" point 8, is referred to as the "current item" 13. For greater clarity, the inserted item 12, in this case item K, and the current item 13, in this case item B, are respectively emphasized in the observation window 10 in FIG. 2 by underlining and by being printed bold. The observation window 10 is shown as having only ten postal items, but it should be understood that in practice the observation window can be larger in size. The size of the observation window is variable as a function of the unstacker and it serves to view six to several hundreds of postal items.

In order to implement the method of the invention, the file or table 14 can record a certain amount of data, and in this example for each of the postal items B to K, the following are recorded: the distribution point 15 for each item as determined by OCR or by reading an identifier in order to perform sorting; the rank 16 of each item for monitoring rank; the logical destination 17 of each item corresponding to a second pass sorting outlet for putting it back into circulation; an identifier 18 of the postal item for tracking the item through the machine; and control data 19 indicative of a recycled or non-recycled state of the postal item. The logical destination 17 is an order number identifying the sorting outlet to which the postal item is to be directed during the second sorting pass. The identifier 18 of the postal item is generally derived from the identification bar codes applied to the postal items during the first pass.

Figures 3, 4:
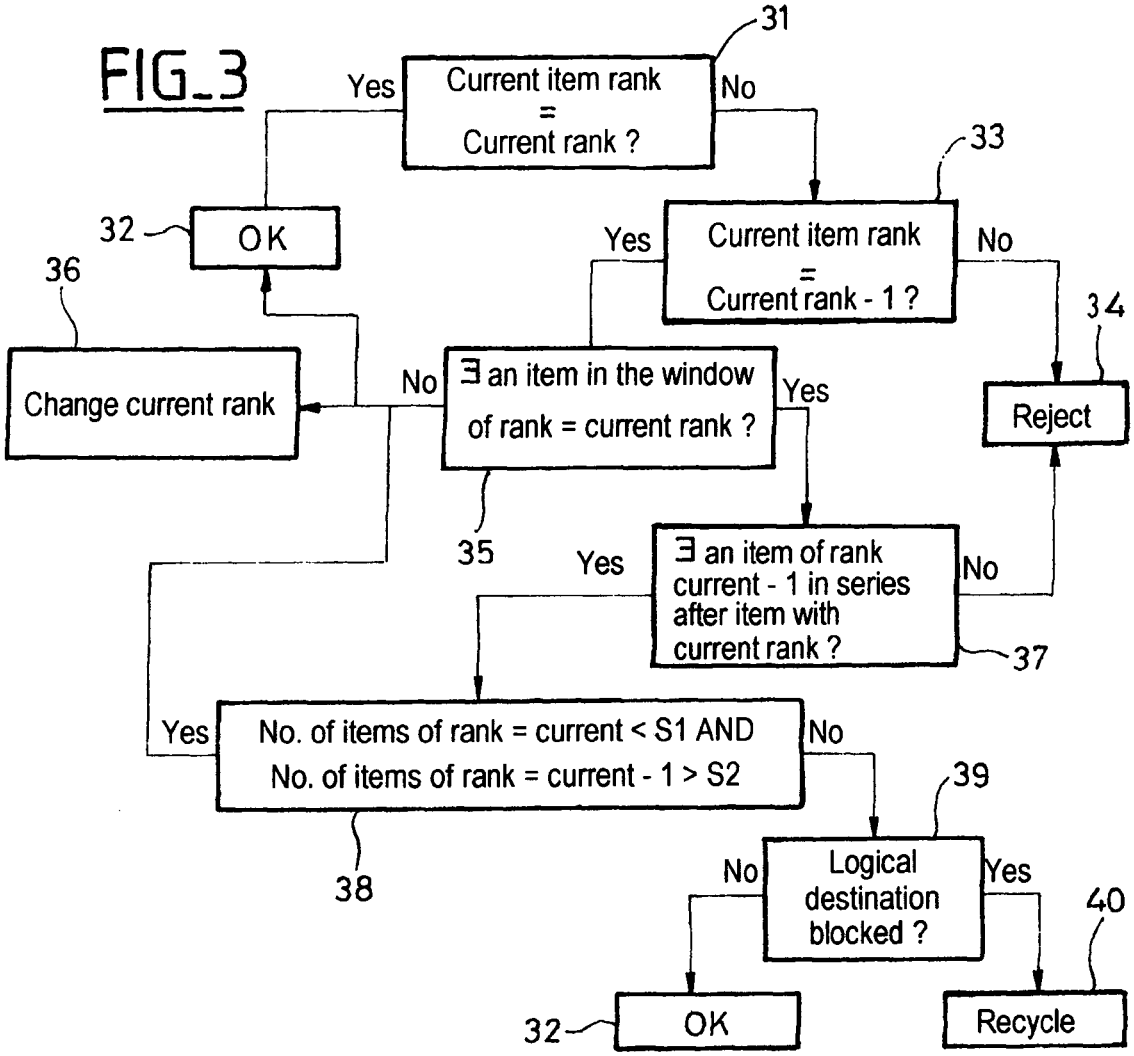
FIG. 3 is a flow chart showing various steps in monitoring rank in accordance with the invention.
FIG. 4 is a table showing an example of the operation of the method of the invention.

FIG. 3 shows an example of how rank monitoring is performed in the method of the invention, and FIG. 4 is in the form of a table 50 summarizing example rank values, in this case N and N−1, for a sequence of postal items that might lead to an item being put back into circulation. In particular, in table 50, "Sanction" column 51 indicates either normal sorting of the current item 13: sanction="OK"; rejection of the current item: sanction="Reject"; or putting the current item back into circulation: sanction="Recycle", as appropriate. The rows referenced L1 to L9 in table 50 correspond to each cycle of rank monitoring and comprise the current rank value (column 52), and the rank values 16 of the postal items present in the observation window.

With reference to FIG. 3, in step 31, it is checked whether the value of the rank 16 of the current postal item 13 in the table 14 is equal to a previously-initialized current rank value, in which case the current item is sorted normally in a sort outlet (step 32). This corresponds to the situation in rows L1, L2, L7, L8, and L9 in table 50. If the rank 16 of the current postal item 13 is different from the current rank, then the method moves onto step 33 where it is verified whether the rank 16 of the current item 13 is equal to the current rank minus one. If not, the current item is rejected (step 34). Otherwise, in step 35, it is verified whether there is a postal item in the observation window having a rank 16 that is equal to the current rank. If not, the current item 13 is sorted normally (step 32) and the value of the current rank is changed to the value of the rank of said current item (step 36). At this stage, the value of the current rank is thus decremented by one. Now, if in step 35, an item in the observation window 10 has a rank 16 equal to the current rank, then the method moves on to step 37 during which it is verified whether there exists at least one item in the observation window 10 that has a rank 16 equal to the current rank minus one, and that has been inserted into the observation window after all of the items in the observation window 10 of rank 16 that is equal to the current rank. If not, the current item 13 is rejected (step 34). This situation corresponds to row L3 in table 50. Otherwise, the method moves on to step 38 during which it is verified whether the number of items in the observation window 10 of rank 16 equal to the current rank is less than a predetermined threshold S1 and simultaneously whether the number of items in the observation window 10 of rank equal to the current rank minus one is greater than a predetermined threshold S2. The values S1 and S2 are adjustable parameters making it possible to ensure that items are put back into circulation as a function of the size of the observation window, the recycle time of an item, and the errors that are encountered the most frequently. Experience shows that using a value S1 of six and a value S2 of three makes it possible to remedy a large number of sorting errors. Briefly, if the number of items with the current rank exceeds S1, there remain too many current-rank items to be sorted for it to be possible to change the current rank, and if the number of items with the current rank minus one is less than S2, there are not enough items with the current rank minus one to decide to change the current rank. If step 38 leads to an affirmative response, then the current item is sorted normally (step 32) and the value of the current rank is updated in step 36. Otherwise, the method moves onto step 39 during which it is verified whether the logical destination 17 of the current item 13 is blocked, i.e. whether there is an item in the observation window 10 of rank 16 equal to the current rank and having the same logical destination 17 as the current item 13. If the logical destination 17 of the current item 13 is not blocked, then the current item is sorted normally in step 32. Otherwise, when the logical destination 17 of the current item 13 is blocked, the current item is put back into circulation in step 40 through the machine. This situation corresponds to rows L4, L5, and L6 in table 50. When items are recirculated in this way, the sorting of the current item 13 is delayed. In practice, the current item can make a complete revolution round the carrousel and reappear subsequently in the observation window 10, i.e. at a moment when the value of the current rank is equal to the value of its own rank. It will be understood that the postal item which makes a complete revolution round the carrousel of trays crosses its injection point in the carrousel of trays. Naturally, putting this postal item into recirculation must be followed by resynchronizing the injection of postal items into the trays of the carrousel, i.e. the presence of an item being recirculated in a tray means that a new item must not be injected into that tray and the new item that would have been injected into the tray is injected into the next available tray.

Clearly by way of indication, the carrousel of a sorting machine has 1000 trays organized as four independent virtual machines correspond to 250 trays for one revolution of the carrousel for each virtual machine, and each rank contains between 240 and 300 postal items. Consequently, when an item placed between items of lower rank is recycled, it is highly probable that it will pass through the sanction point again while it is surrounded by items having the same rank as itself.

Furthermore, it is known from the first sorting pass how many items there are that belong to each rank. It is therefore possible to verify whether it is useful to recycle an item by using the known number of items belonging to each rank in order to calculate the rank of the items between which this item will be located after making a complete revolution round the carrousel.

In general, steps 31, 33, and 35 serve to verify whether there is lack of coherence in the order that postal items go past, while steps 37, 38, and 39 consist in determining whether the current item needs to be rejected, sorted, or recycled through the machine in order to re-establish coherence in the sequence of second-pass items.

The control data 19 serves to avoid causing any one postal item to be recycled twice. In particular, if during the second pass of an (already recycled) postal item through rank monitoring it is still not possible to sort the item normally, then it is rejected.

The idea of putting back into circulation the current postal object after having made this current postal item perform a complete revolution of the carrousel can be implemented different ways, i.e. by using various criteria or conditions to decide the recirculation of an item.

Figure 5:
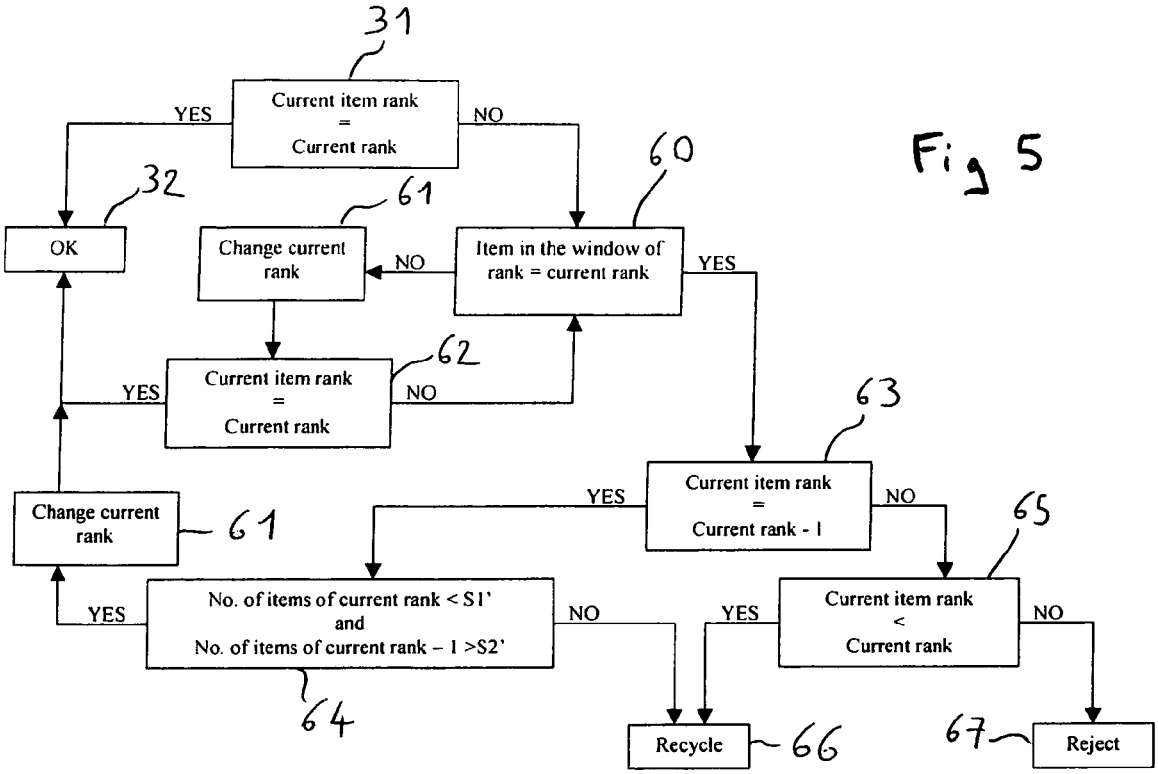
FIG. 5 is a flow chart showing a second way of implementing the method in accordance with the invention.

FIG. 5 represents for example an other way to implement the method in accordance with the invention compare to the one described in reference to FIG. 3. The sorting machine is arranged or programmed to perform automatically the different steps of the method in accordance with the invention and to decide and control the accomplishment of this various method steps according to the various circumstances. In step 31 of FIG. 5, similar to step 31 of FIG. 3, it is checked whether the rank 16 of the current postal item is equal to a previously-initialized current rank. If the rank of the current postal item is equal to the current rank, the current item is sorted normally in a sort outlet (step 32). If the rank of the current postal item is different from the current rank, it is checked in step 60 whether there is a postal item in the observation window having a rank equal to the current rank. If no postal item in the observation window presents the current rank, the current rank is changed at step 61, i.e. that the current rank is decremented by one of said current item, and it is checked one more time at step 62 if the rank of the current postal item is equal to the new current rank. If yes, the current postal item is sorted at step 62. If not, the process moves back to step 60. The loop constituted by steps 60, 61 and 62 is, for example, a way to have the current rank changed in order to perform the rank monitoring. The current rank varies according to the postal items present in the observation window. For sorting safety reason, the current rank might not be changed twice in row, i.e. the loop might not be traced twice. If at least one postal item in the observation window is of current rank, it is checked in step 63 if the rank of the current postal item is equal to the current rank minus one. In the affirmative, it is verified during step 64 whether the number of items in the observation window of rank equal to the current rank is less than a predetermined threshold S1' and simultaneously whether the number of items in the observation window of rank equal to the current rank minus one is greater than a predetermined threshold S2'. The thresholds S1' and S2' correspond to the thresholds S1 et S2 of step 38 of FIG. 3. In the affirmative, the current rank is decremented by one unit (step 61) and the current postal item is sorted. In the negative in step 64, the recirculation of the current postal item is controlled in step 66 in the machine by making the current postal item perform a complete revolution of the carrousel. If the rank of the current postal item is different from the current rank minus one (step 63), it is checked in step 65 if the rank of the current postal item is lower than the current rank. If the rank of the current postal item is lower than the current rank, a recirculation is controlled for the current postal item, while if the rank of the current postal item is greater than the current rank, the current postal item is rejected in step 67. A current postal item of rank greater than the current rank can not be restored in sequence through a recirculation because the items of the item sequence in which it should have been sorted have already been sorted.

In this way to implement the method in accordance with the invention, the postal items having a rank equal to the current rank minus one are distinguished from the postal items having a rank lower than this current rank minus one because a way is revealed (step 64) for sorting directly the postal items having a rank equal to the current rank minus one while minimizing the incidence on the throughput of the sorting machine. The way of implementing the method in accordance with the invention of FIG. 5 shows a close connection between the variation of the current rank and the criteria for deciding the control of a recirculation.

Figure 6:
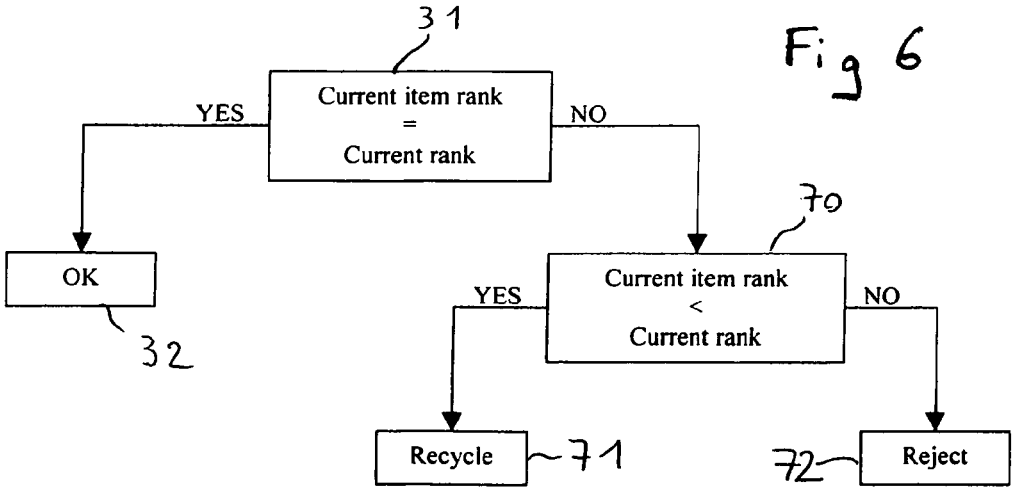
FIG. 6 is a flow chart showing a third way of implementing the method in accordance with the invention.

According further to an other way to implement the method in accordance with the invention, illustrated on FIG. 6, all the current items having a rank lower than the current rank are considered the same way, i.e. are recirculated, and the variation of the current rank is decided independently of the process of decision for the sort of the postal items.

It is checked in step 31 of FIG. 6, similar to step 31 of FIG. 3 or FIG. 5, whether the rank of the current postal item is equal to a previously-decided current rank. If the rank of the current postal item is equal to the current rank, the current item is sorted normally in a sort outlet (step 32). If the rank of the current postal item is different from the current rank, it is checked in step 70 whether the rank of the current item is lower than the current rank. If the rank of the current item is lower than the current rank, a recirculation (step 71) of the current item is controlled and if the rank of the current item is greater than the current rank, a rejection (step 72) of the current item is controlled. The variation of the current rank is monitored independently from the detection of the difference relative to the predetermined expected sequence and of the practical criteria for deciding the recirculation of the current item. The variation of the current rank can be monitored and the current rank decremented for example by means of a simple loop similar to steps 60-62 of FIG. 5 or by using decision parameters more complexes referring for example to an observation of the observation window and the use of different thresholds. This current rank is determined before starting the method described with reference to FIG. 6. Referring to FIG. 6, any current item having a rank lower than the current rank is recirculated because this current item normally has to be sorted while being surrounded by postal items having the same rank than the current item has and that will consequently succeed the current item during this sorting pass. Then whatever the rank of the current item is, there is a probability for this current item to pass again, after one or several rotation in the carrousel, i.e. after having be delayed for sort, about the sanction point 8 for the rank monitoring while being surrounded by items of its rank.

Recirculating a current postal item consists in keeping it in the tray of the carrousel in which it lays while passing the tray above every sorting outlets without depositing the item and in presenting this item again always in the same tray in the observation window and about the point where the sanction to apply to this item, which become consequently again the current item, is decided. Consequently, when a current item is recirculated by making it performing a complete revolution of the carrousel, it is decided to sort a given number of consecutive items succeeding the current item, actually as many items as the number of trays of the carrousel, before taking a new decision relative to its sort. During a recirculation operation, the machine is controlled in order the current item performs a complete revolution in the carrousel so as to delay the deposit in an appropriate sorting outlet. Thus a current item, which has already performed a complete revolution in the carrousel succeeds in the sort to a sequence of postal items which was succeeding this item at the time of the rank error detection and of the control of the recirculation. The recirculation decision and the accomplishment of the recirculation is wholly automatic, the item does not leave the sorting machine et does not has to be reintroduced in the machine, it follows normally its path in the machine to be sorted after a given delay.

After a complete revolution of the carrousel of trays, or several revolutions if it is decided to permit several successive recirculation, the recirculated item can be replaced in the expected sequence and therefore be sorted. To verify that the item is indeed in the expected sequence, the rank monitoring is used, i.e. it is checked if the rank of the current item, when the recirculated item become again the current item, corresponds indeed to the current rank. In the above described examples, this rank monitoring, to verify that the obtained sequence after recirculation is correct, is done automatically and explicitly-because of the loop application of the method described for example with reference to FIGS. 3 and 5 to every postal items introduced in the observation window and therefore to the recirculated postal items.

An other implementation of the idea in accordance with the invention consists in automatically recirculating a postal object during a second sorting pass when this item can not be directly sorted, for example when an error in the expected sequence is detected or when the sorting outlet in which the postal item has to be deposited is not ready to receive an item at the time the item pass in the tray above the sorting outlet, for example because a tub replacement is taking place in the concerned sorting outlet, followed by a rank monitoring to verify that the recirculated item passing about the sanction point has a rank that corresponds to the current rank and therefore can, or can not, be sorted, or further can be recirculated again according to the criteria exposed previously for example with reference to FIGS. 3, 5 and 6. The combination recirculation followed by a rank monitoring can be used each time a sorting error has been detected.

The rank monitoring has then for purpose to verify if an item recirculated in the carrousel of trays can be sorted because it is effectively surrounded by items having the same rank than it has. Such a verification allows the user to take advantage of the recirculation possibilities given by a machine having a carrousel of trays during a second sorting pass, the recirculation possibilities being until now not compatible with the necessity to maintain unchanged the item sequence during this second sorting pass.

What is claimed is:

1. A method of processing postal items in order to prepare delivery rounds by performing a plurality of sorting passes through a postal sorting machine having a carrousel of trays in which the postal items travel in trays above sorting outlets and are deposited in the appropriate sorting outlets according to distribution points of postal items, the method comprising the steps of:

determining during a certain sorting pass a sequence of distribution points for postal items to run through a subsequent sorting pass;

checking in the machine during said subsequent sorting pass and for each current item, data representative of an order number or rank allocated to the distribution point corresponding to the current postal item in said determined sequence of distribution points in order to prepare each delivery round;

said checking comprising monitoring how rank varies for successive postal items in order to detect any difference relative to said predetermined sequence; wherein in response to said detection for a current postal item, the machine further comprises the step of:

controlling the machine to cause the current item to recirculate through the machine without being deposited in a sorting tray by making this current item carrying out one complete revolution round the carrousel so as to delay its deposit in a sorting outlet.

2. The method of claim 1, in which the rank is observed for the current postal item and this current item is caused to recirculate in response to detection of the rank of the current postal item being lower than a current rank.

3. The method of claim 1, wherein in response to said detection of a difference of rank relative to said determined sequence for a current postal item;

the rank of the current postal item is observed in a portion, or "observation window", of a sequence constituted by a certain number of consecutive postal items; and in response to detection of the rank of the current postal item being one less than a current rank, a first number of postal items of rank one more than the current postal item is counted in the observation window and a second number of postal items having the same rank as the rank of the current postal item is counted in said window; and if the first number is lower than a determined first threshold S1 and the second number is greater than a determined second threshold S2, then the machine is controlled so as deposit the current postal item in the appropriate sorting outlet; while if the first number is greater than the determined first threshold S1 and/or the second number is less than the determined second threshold S2, the method further comprises the step of controlling the machine to cause the current item to recirculate by returning to the observation window after making one complete revolution round the carrousel.

4. The method of claim 3, in which, in the observation window, an observation is made of the sorting outlet in which a certain number of consecutive postal items are to be deposited, and if the first number is greater than the first determined threshold (S1) and/or the second number is less than the second determined threshold (S2), and if no postal item of rank one unit greater than the rank of the current postal item is to be deposited in the sorting outlet in which the current postal item is to be deposited, then the machine is caused to deposit the current postal item in the appropriate sorting outlet.

5. The method of claim 1, wherein the method comprises the steps which,: if it is detected that a postal item transported in the machine by the carrousel of trays cannot be deposit into a sorting outlet; this postal item is caused to recirculate by controlling the machine in order that this postal item performs a complete revolution round the carrousel.

* * * * *